US005180881A

United States Patent [19]

Wootton et al.

[11] Patent Number: 5,180,881

[45] Date of Patent: Jan. 19, 1993

[54] BEAM STEERED LASER FOR FIRE CONTROL

[75] Inventors: John R. Wootton; Gary Waldman, both of St. Louis, Mo.

[73] Assignee: Electronics & Space Corp., St. Louis, Mo.

[21] Appl. No.: 713,877

[22] Filed: Jun. 12, 1991

[51] Int. Cl.[5] ..... F41G 3/16; F41G 3/06

[52] U.S. Cl. ..... 89/41.19; 89/41.06

[58] Field of Search ..... 89/41.06, 41.19, 41.21, 89/41.22

[56] References Cited

U.S. PATENT DOCUMENTS

| | | | |
|---|---|---|---|
| 3,904,163 | 9/1975 | Kendy et al. | 248/358 R |
| 4,011,789 | 3/1977 | Bresee, Jr. et al. | 356/4 |
| 4,040,744 | 8/1977 | Schertz et al. | 356/152 |
| 4,062,267 | 12/1977 | Vinches et al. | 89/41.06 |
| 4,161,652 | 7/1979 | Moreau et al. | 356/152 |
| 4,213,700 | 7/1980 | Leblanc | 356/73 |
| 4,404,890 | 9/1983 | McAlpine | 356/252 |
| 4,577,962 | 3/1986 | de Guillenschmidt et al. | 89/41.06 |
| 4,665,795 | 5/1987 | Carbonneau et al. | 89/41.06 |
| 4,695,161 | 9/1987 | Reed | 356/254 |
| 4,787,291 | 11/1988 | Frohock, Jr. | 89/41.22 |
| 4,876,942 | 10/1989 | Nilsson | 89/41.22 |
| 4,922,801 | 5/1990 | Jaquard et al. | 89/41.22 |

FOREIGN PATENT DOCUMENTS

| | | | |
|---|---|---|---|
| 3325755 | 1/1985 | Fed. Rep. of Germany | 89/41.06 |
| 626111 | 8/1927 | France | 89/41.22 |

*Primary Examiner*—Stephen M. Johnson

*Attorney, Agent, or Firm*—Polster, Lieder, Woodruff & Lucchesi

[57] ABSTRACT

Fire control apparatus (30) comprises a gun (32) for firing a projectile at a target (T). The gun is mounted on a platform (36) which is subject to vibratory motion. A laser unit (40) generates a laser beam directable at the target. A gunner (G) directs a laser beam at the target and a return laser waveform reflected by the target is received back at the platform. A processor (44) is responsive to the return waveform to determine the target's range, speed, and direction of movement relative to the platform. Further, the processor determines a firing solution by which a projectile fired from the gun strikes the target. This solution includes a lead angle by which the gun should be directed ahead of the target for the projectile to strike it. A beam steering unit (62) is responsive to an output from the processor to realign the laser beam relative to the target. The degree of realignment is in accordance with the firing solution so the projectile fired from the gun strikes the target. The beam steering unit also stabilizes the laser beam to isolate it from platform vibrations. This is done to increase system accuracy.

19 Claims, 3 Drawing Sheets

BEAM STEERED LASER FOR FIRE CONTROL

BACKGROUND OF THE INVENTION

This invention relates to fire control systems for military applications and, more particularly, to such a system employing a beam steered laser to eliminate firing errors and increase accuracy.

Laser fire control systems are known in the art. See, for example, U.S. Pat. Nos. 3,904,163, 4,161,652, 4,213,700, 4,577,962, 4,665,795, 4,695,161, 4,787,291, and 4,876,942. It is also known to incorporate portions of fire control systems into goggles, helmets, or similar apparatus worn by a user of a fire control system. See, for example, U.S. Pat. No. 4,040,744. Of recent interest is a beam steered laser for fire control system which incorporates night vision goggles. In this system, a laser beam is steered to a point (or points) where the potential fall of a projectile will hit. Since the fire control system is mounted on some type of platform (tank, helicopter, boat, etc.) the system must take into account not only the ballistics of the projectile, but also platform motion. A gunner using this system performs a series of functions one of which includes range finding, and another of which is target designation. For this purpose, a laser is co-located with the gunner who operates the laser in a pulse mode, for example, for target ranging, and in a continuous wave (CW) mode for target designation. In operation, the gunner first performs target location and ranging operation. A system computer then computes a lead angle by which the firing unit must lead the target in order for the round to hit it. The gunner now uses this information to realign the laser and designate the target. At this time, the system is ready to fire a projectile at the designated target.

The system as outlined does have certain disadvantages. For example, the lead angle is not continuously recomputed. Therefore, any delay (latency) by the gunner in realignment of the laser and firing of a round may produce a firing error and a missed target. In addition, platform movement and vibration may make it difficult for the gunner to maintain the realigned beam on the designated target.

There are various approaches which may be undertaken to resolve the above noted problems. For example, an instrumented two axes, stabilized laser could be used as a reference for the gun. The gun and laser would be slaved together using either the gunner or an appropriate servo-system so necessary corrections are made before firing. In such a system, the laser would be vibration isolated and stabilized so as to provide a stable platform. Thus, a servo for the laser would require wideband capability to help compensate for stabilization errors and the platform would be stable for appropriate fire control pick-ups and would create a stable, spatial reference. There are three drawbacks to this approach. First, because the stabilization servo is a mechanical unit, it has a limited bandwidth. Second, again because the servo is mechanical, it is difficult to retain boresight because of vibrations (whether platform, gun firing, or both). Third, the usefulness of a mechanical servo in a high vibration environment for any prolonged period is questionable.

All of these limitations can be circumvented if a totally electronic beam steered laser having no mechanical parts is used. The steering of the laser away from the direction of the gun would compensate for ballistic corrections, kinematic corrections, and short duration rotational and translational movements of the platform on which the gun is mounted. This latter capability also facilitates the possibility of coincidence firing.

SUMMARY OF THE INVENTION

Among the several objects of the present invention may be noted the provision of a laser fire control system in which a laser is employed for both target ranging and target designation; the provision of such a system utilizing a dual axis totally electronically stabilized laser beam so the laser beam is isolated from platform vibrations, thereby increasing system accuracy; the provision of such a system having a high probability single shot hit capability; the provision of such a system to be usable on a wide variety of vehicles including land, sea, and air vehicles, and in which the system is readily adapted for use in any appropriate vehicle to provide a stable laser platform; the provision of such a system to employ a strapped down, beam steered visible or infrared (IR) laser system which provides both a high degree of system reliability and accuracy at a relatively low cost and with a maximum degree of application flexibility; the provision of such a system in which the gunner acts as an integral part of the system regardless of the battlefield environment, time of day, etc. in which the system is used; and, the provision of such a system to be a compact, solid state unit having no moving parts and which fits on the gun with which it is used.

In accordance with the invention, generally stated, a fire control apparatus comprises a gun for firing a projectile at a target. The gun is mounted on a platform which may or may not be subject to vibratory motion. A laser unit generates a laser beam directable at the target. A gunner directs a laser beam at the target and a return laser waveform reflected by the target is received back at the platform. A processor is responsive to the return waveform to determine the target's range, relative speed, and direction of movement relative to the platform (this latter being determined by an inertial measurement unit in conjunction with the processor). Further, the processor determines a firing solution by which a projectile fired from the gun strikes the target. This solution includes a lead angle by which the gun should be directed ahead of the target for the projectile to strike it. A beam steering unit is responsive to an output from the processor to position or misalign the laser beam initially relative to the gun. The degree of misalignment is in accordance with the firing solution so the projectile fired from the gun strikes the target. The beam steering unit also acts to stabilize the laser beam so to isolate it from short term platform vibrations. This helps maintain the laser on the target so to increase system accuracy.

The gunner will be provided appropriate night sights and a day monocle so to observe the laser. His task is to maintain the laser on the target. In effect, the gunner provides a low frequency content for kinematic predictions, whereas the high frequency content (the short duration rotational and translational movements) are provided by a combination of the processor, the inertial measurement unit, and the steered laser. Other objects and features will be in part apparent and in part pointed out hereinafter.

BRIEF DESCRIPTION OF THE DRAWINGS

FIGS. 1*a*, and 1*b* represent a prior art fire control system;

Corresponding reference characters indicate corresponding parts throughout the drawings.

DESCRIPTION OF PREFERRED EMBODIMENTS

Figure 1A:
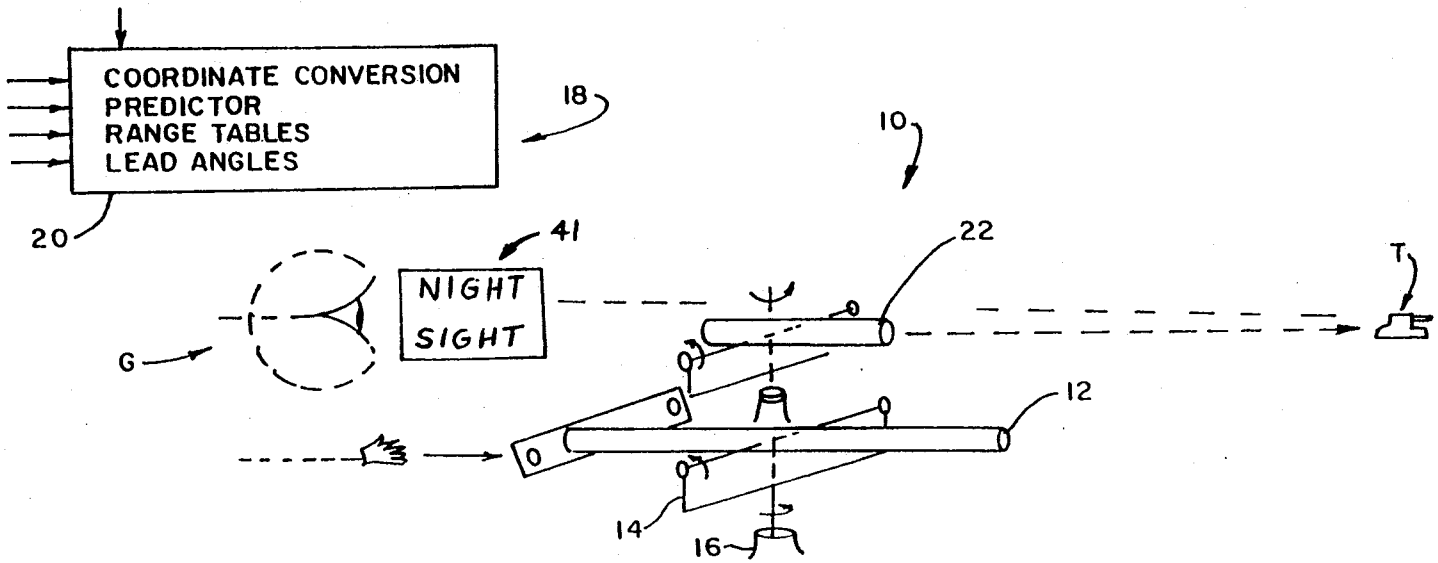
FIG. 1A. PRIOR ART

Referring to the drawings, a conventional fire control apparatus 10 is illustrated in FIG. 1a. As shown, a gun 12 is installed on a movable platform 14 which, in turn, is installed on a platform 16. A gunner G is capable of moving the gun on its mount so it can be aligned to shoot at a target such as a tank T. It will be understood that the gun may be installed in any of a variety of ways on any of a variety of land, sea, or air vehicles, and that the target may also be any of a variety of targets which may include land, sea, or air vehicles. Typically, the vehicle on which the system is installed is moving. Consequently, the gunner is provided with a fire control system 18 (see FIG. 1b) by which various relative parameters are measured and some type of indication is provided to him as to when, and in which direction, he should fire the gun in order for the discharged projectile to impact on the target. These parameters include such things as the distance (range) between the gun and the target, the target's speed and direction of movement, the platform's speed and direction of movement, etc. System 18 incorporates a fire control computer 20 that utilizes these various factors to compute a firing solution which the gunner may then implement.

One way in which the information required by the fire control computer is acquired is through use of a laser 22 which is mounted on or adjacent the gun. The laser generates a laser beam which is directed at the target. A return wave reflected back from the target is then processed to obtain range (and motion, if any) information. After processing by the fire control computer, the laser is then realigned in accordance with the output from the computer to enable the gunner to properly lead the target as he prepares to fire at it.

Figures 2A, 2B, 2C:
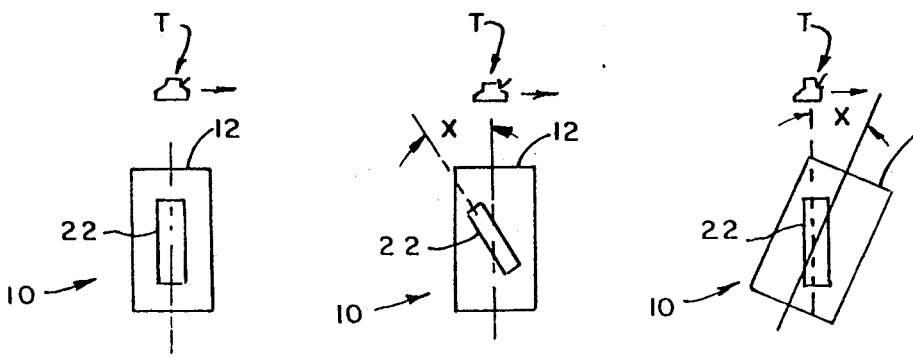
FIGS. 2a–2c represents a sequence of the fire control system's operation.

The above described sequence is illustrated in FIGS. 2a–2c. As seen in FIG. 2a, laser 22 is axially aligned with the boresight of gun 12. Initially, both are commonly directed at the target T. The operations performed by computer 20 results in a lead angle X being computed, this angle representing the amount by which the gun must lead the target in order for a projectile fired by the gun to strike the target. It will be understood that angle X represents azimuth only and that a corresponding elevation lead angle though not shown is also computed and must be taken into account. As seen in FIG. 2b, the fire control system adjusts the laser so it trails the target by an amount equal to lead angle X. (A similar elevation adjustment is also made.) The boresight of gun 12 is maintained on the target at this time. Thereafter, as shown in FIG. 2c, the gunner rotates the mount so the laser beam is now directed at the target. This movement by the gunner now displaces the boresight of the gun so it leads the target by an angle corresponding to the lead angle. So long as the gunner maintains the laser beam on the target, the correct lead angle will be maintained and the gunner should be able to hit the target.

While the above system works from a theoretical standpoint, in actuality, this system is difficult to implement. A major reason for this is platform vibration, especially during firing of the gun, which makes it extremely difficult for the gunner to keep a laser beam trained on the target. There are two types of vibration which contribute to the problem. One is the inherent vibration associated with the type of vehicle on which the platform is installed. A second is the short term vibrations which are caused by the particular environment in which the vehicle is present at a particular time (the type of terrain encountered, wave motion, turbulence, etc.) as well as the type of maneuvers the vehicle may be making. It will be appreciated that at the time of firing, the short term vibration is exacerbated by the gunfire. Regardless of the degree to which these types of vibration effect the laser, the net effect is a reduction in accuracy, particularly as the laser has to strike the target in order to provide the range information which is intrinsic in a good fire control solution.

In attempting to solve this problem, two approaches which could be used include a) somehow stabilizing the laser; or b) stabilizing the laser beam irrespective of stabilization of the laser itself. With respect to the former approach, the structural requirements (mounts, pads, etc.) which may be necessary to isolate the laser from vibrations may impose too many restrictions (size, weight, manuverability, etc.) on the overall operation of the system to justify the resultant increase in system accuracy. With respect to the latter approach, there are two ways it can be implemented. One of these is an electro-mechanical system utilizing mirrors or wedges whose position is varied in response to sensed vibrations. While this approach is feasible, the fact that physical structures are being manipulated imposes certain restraints vis-a-vis response times of electro-mechanical systems to transitory vibration effects, for example. The other approach is to have no moving parts and rather, to effect beam stabilization purely electronically.

Figure 3:
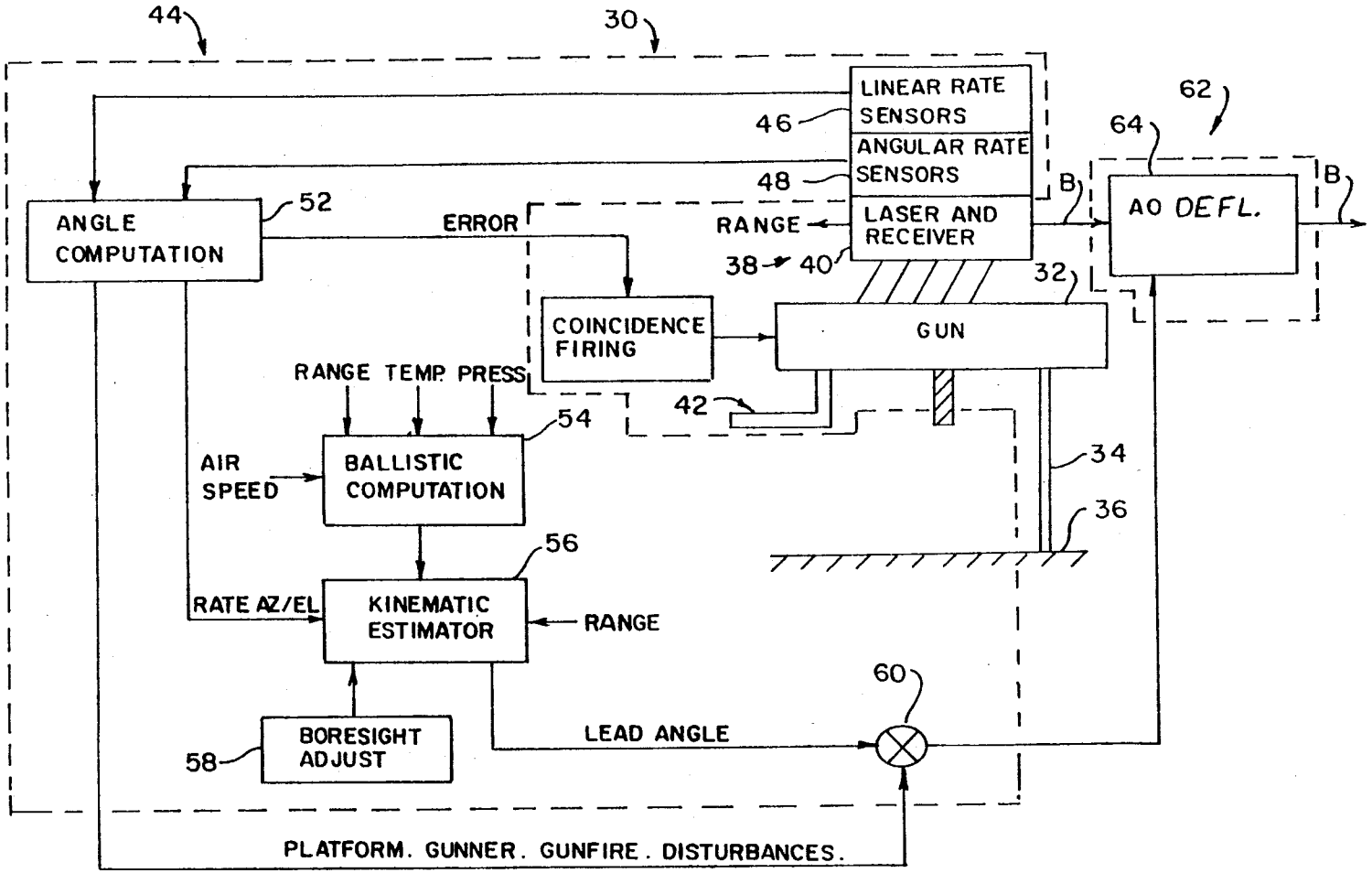
FIG. 3 is a block diagram of fire control apparatus of the present invention.

Referring now to FIG. 3, a fire control apparatus 30 of the present invention includes a gun 32 for firing a projectile at a target T. The gun is installed on a movable mount 34 which, in turn, is installed on a platform 36. As with the platform of system 10, platform 36 is subject to vibratory motion. A laser means 38 includes a laser unit 40 for generating a laser beam B directable at the target. The laser unit is a solid state visible or infrared laser having both a pulsed mode of operation, for target location, and a continuous wave (CW) mode of operation for target designation. Alternatively, the laser unit can be a CW laser which is modulated to provide ranging information, and unmodulated for target designation purposes. The laser unit is preferably installed on the gun. The laser unit not only emits a beam of laser radiation, but is also capable of receiving a return waveform reflected back toward the laser unit from the target. This return beam is processed for range information, but is also observed by an gunner using an electro-optical device such as a night sight 41 worn by him.

A targeting means 42 is operable by a gunner for directing the laser beam at the target and for receiving a return laser waveform reflected by the target back toward the platform. As represented in FIG. 3, the targeting means may be any convenient mechanical, or electro-mechanical construction by which the gunner can direct the gun/laser configuration at a target.

Apparatus 30 next includes processing means indicated generally 44. Means 44 is responsive to the return waveform to determine the target's range, speed, and direction of movement relative to platform 36. The processing means first includes one or more linear rate sensors 46, and one or more angular rate sensors 48. These sensors measure both the speed and direction of target movement Their output is directed to an angle computation means 52 which determines a trajectory angle between the gun and the target. This information includes the azimuth and elevation of the gun (to a reference) at any time. This information is provided to a ballistics computation means 54 which determines the ballistic trajectory for a projectile to be fired at the target. For this purposes, means 54 utilizes not only the positional information relating to the gun, but also range information derived by unit 40 from the return waveform, air speed of the vehicle on which the gun is carried, air temperature, air pressure, etc. The selection of higher quality sensor components for developing this information is in concert with an overall single shot hit probability required of the system.

A kinematic estimator 56 combines information computed by both the angle and ballistics computation means to determine a firing solution by which a projectile fired from the gun will strike the target. In addition to the input from these two means, estimator 56 also receives as inputs the range to target information, and information from a boresight adjust unit 58. This latter input takes into account any difference between the "zero" sightline of the laser beam and the boresight of gun 32.

The firing solution developed by the processing means includes a lead angle (having both azimuth and elevation constituents) by which the gun should be directed ahead of the target for the projectile to strike it. The output from estimator 56, which represents the computed lead angle is provided as one input to a summing unit 60. As provided as an input to the summing unit is an output from angle computation means 52 whose value represents gunfire disturbances, gunner movements, and platform motion (both long term motion due to vehicle and platform construction, and transitory motions due to vibrations).

A beam steering means 62 responsive to the processing means for realigning the laser beam relative to the target. This realignment is in response to an input from summing unit 60, and is therefore in accordance with the firing solution developed by the processing means. Means 62 includes any device capable of steering a laser beam and which does not use electro-mechanical components. Whereas any wedge, mirror, or servo fits the former requirement, these three mechanisms do not fit the latter one.

Means 62, however, can first include a two-axis acousto-optical deflector 64, which is placed directly in the path of the laser beam as shown in FIG. 3. As is known in the optical arts, an acousto-optical deflector is a device which interacts ultrasonically with a light beam to vary the characteristics of the beam. Because the interaction is ultrasonic, the deflector has no moving parts. Not only does this allow faster response to vibrations than is possible with mechanical or electro-mechanical devices, but there are no moving parts to fail. Consequently, the deflector acts to effectively isolate the laser beam from platform motion which, in turn, enhances system accuracy.

Figure 4D:
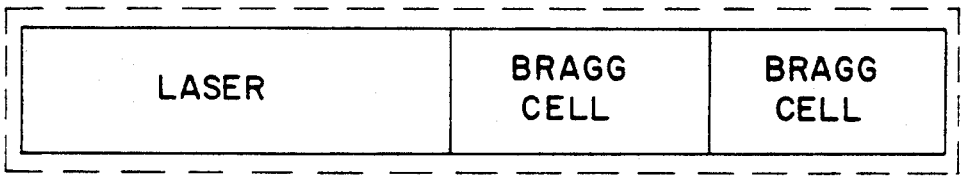
FIG. 4a is a representation of one alternate beam steering arrangement used in the system; and, FIG. 4b is a representation of a second alternate beam steering arrangement.
FIG. 4c is a representation of a third alternate beam steering arrangement and, FIG. 4d is a representation of a fourth alternate beam steering arrangement; and, FIG. 4e is a representation of a fifth alternate beam steering arrangement.
FIG. 4f is a representation of a sixth alternate beam steering arrangement.
Figure 4E:
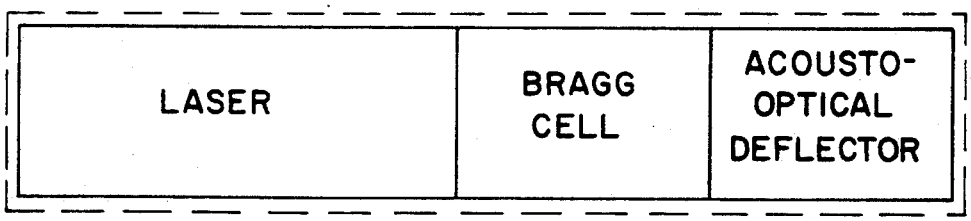
Figure 4F:
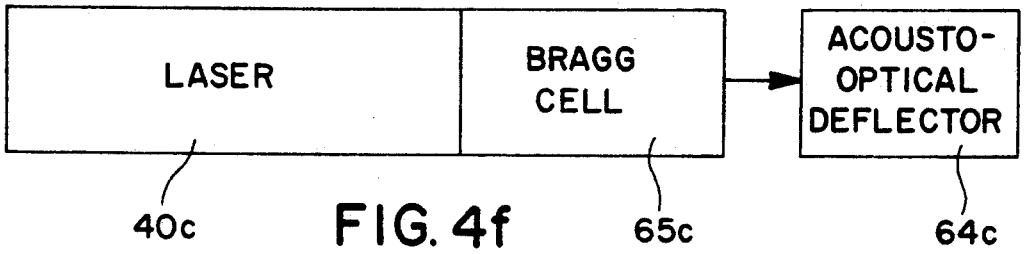

Alternately, a means **62*a* may include single-axis deflector device incorporated within the laser unit itself. Deflection within the other axis would then be by a single-axis acousto-optical deflector 64*a*. Such a laser is shown in FIG. 4*a* in which a laser unit 40*a* is a grating surface emitting laser having an integral Bragg cell 65*a***. By tuning the pumping of the laser, the beam can be made to vary between large angles with the maximum beam deflection being a function of grating length. This combination of one-axis deflection using the internal Bragg cell effect on the laser beam, and the orthogonal single-axis acousto-optical deflector, has a bandwidth which exceeds that of electro-mechanical devices. Further, it consistently and effectively isolates the laser beam from platform vibrations.

Also alternately, a means **62*b* include a two-axis steering mechanism in which the laser beam is generated by a laser unit 40*b* such as shown in FIG. 4*b*. Unit 40*b* has an integral two-axis beam steering capability which is effected by Bragg cells 65*b*, acousto-optical deflectors 64*b*, or a combination of both. Further, as shown in FIG. 4*c*, a means could include a respective laser 40*c* and its associated Bragg cell 65*c*. In this embodiment, however, the acousto-optical deflector is a single axis element 64*c***.

What has been described is a simple, relatively inexpensive solution to a problem which occurs in a number of different potential operating environments. The apparatus of the invention is easily implemented. At the same time other features are preferably incorporated in the apparatus. For example, the apparatus may include a coincidence firing unit 66. This unit is responsive to an output from the angle computational means 52 to effect firing of gun 32 under an appropriate set of conditions. This occurs when the direction in which the gun is pointed coincides with the direction at which the gun should be pointed, taking into account the calculated lead angle for which a projectile fired by the gun should strike the target.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Fire control apparatus for locating a target at which a projectile is to be fired from a gun, determining the range between said gun and said target, and for thereafter designating said target so a projectile fired by said gun strikes said target comprising:

a gun for firing a projectile at a target, said gun being manually movable by a gunner;

a platform on which said gun is mounted, said platform being subject to vibratory motion;

laser means for generating a laser beam directable at said target, said laser means comprising a multimode laser operable in both a pulsed mode and in a continuous-wave (CW) mode, said pulsed mode being used for determining said target's range and said continuous-wave mode when said laser beam is designating said target;

targeting means operable by said gunner for directing said laser beam at said target and for receiving a return laser waveform reflected by said target back toward said platform;

processing means responsive to said return waveform to determine said target's range and direction of movement relative to an axis of said platform, and for determining a firing solution by which said projectile fired from said gun strikes said target, said solution including a lead angle by which said gun should be directed ahead of said target for said projectile to strike said target; and, beam steering means responsive to said processing means for realigning said laser beam relative to said target in a accordance with said firing solution whereby said projectile fired from said gun strikes said target, said beam steering means stabilizing said laser beam to isolate said laser beam from platform vibrations and enhance system accuracy.

2. The apparatus of claim 1 wherein said laser means is mountable on said gun.

3. The apparatus of claim 1 wherein said beam steering means includes a two-axis acousto-optical deflector.

4. The apparatus of claim 1 wherein said beam steering means includes a Bragg cell incorporated in said laser means and providing one-axis of beam steering, and a single-axis acousto-optical deflector external of said laser means for providing beam steering in a second and orthogonal axis.

5. The apparatus of claim 1 wherein said beam steering means includes two Bragg cells incorporated in said laser means with each Bragg cell providing one-axis of beam steering, one said Bragg cell providing beam steering on one axis and the other said Bragg cell providing beam steering in a second and orthogonal axis.

6. The apparatus of claim 1 wherein said beam steering means includes one Bragg cell and one acousto-optical deflector incorporated in said laser means with said Bragg cell providing one-axis of beam steering, and said acousto-optical deflector providing beam steering in a second and orthogonal axis.

7. The apparatus of claim 1 wherein said beam steering means includes two acousto-optical deflectors incorporated in said laser means with each deflector providing one-axis of beam steering, one said deflector providing beam steering on one axis and said other deflector providing beam steering in a second and orthogonal axis.

8. The apparatus of claim 1 wherein said processing means includes angle computational means responsive to measured linear and angular rates of target movement for computing a trajectory angle between said gun and said target.

9. The apparatus of claim 8 wherein said processing means further includes ballistic computation means responsive to target range information for computing a ballistic path from said gun to said target.

10. The apparatus of claim 9 wherein said processing means further includes means responsive to outputs from both said angle computational means and said ballistic computational means for determining said lead angle by which said gun should be aimed ahead of said target so said projectile fired by said gun intersects said target path and strikes said target.

11. The apparatus of claim 8 further including coincidence firing means responsive to an output from said angle computational means for effecting firing of said gun if the direction in which said gun is pointed at any one time coincides with that which includes said calculated lead angle for said projectile fired by said gun to strike said target.

12. A method of fire control for locating a target at which a projectile is to be fired from a gun, determining the range between said gun and target, and for thereafter designating said target so a projectile fired by said gun strikes said target comprising:

generating a laser beam directable at said target;

directing said laser beam at said target and receiving back a return laser waveform reflected by said target;

processing said return waveform to obtain information on said target's range, velocity, and direction of movement relative to said gun;

determining a firing solution, using the information, by which said projectile fired from said gun strikes said target, said firing solution including a lead angle at which said gun is directed ahead of said target for said projectile to strike said target; and, steering said laser beam by a beam steering means in response to said firing solution to realign said laser beam relative to said target whereby said projectile fired from said gun strikes said target, said beam steering means also stabilizing said laser beam to isolate said laser beam from platform vibrations and enhance system accuracy, steering of said laser beam by said beam steering means including steering with a two-axis acousto-optical deflector.

13. The method of claim 12 wherein steering said laser beam includes steering with a single-axis Bragg cell incorporated in means for generating said laser beam, and a single-axis acousto-optical deflector external of said laser generating means for providing beam steering in a second and orthogonal axis.

14. The method of claim 12 wherein steering said laser beam includes steering with two Bragg cells with one said Bragg cell providing beam steering on one axis and the other said Bragg cell providing beam steering in a second and orthogonal axis.

15. The method of claim 12 wherein steering said laser beam includes steering with one Bragg cell and one acousto-optical deflector with said Bragg cell providing one-axis of beam steering, and said acousto-optical deflector providing beam steering in a second and orthogonal axis.

16. The method of claim 12 wherein steering said laser beam includes steering with two acousto-optical deflectors with each deflector providing one-axis of beam steering, one said deflector providing beam steering on one axis and the other said deflector providing beam steering in a second and orthogonal axis.

17. The method of claim 12 wherein said processing said return waveform includes determining both said target's linear and angular speed, and its direction of movement.

18. The method of claim 17 wherein said processing said return waveform further includes performing said lead angle computation and a ballistic computation for said projectile's trajectory.

19. The method of claim 18 further including firing of said gun if the direction in which said gun is pointed at any one time coincides with that direction which includes said computed lead angle for said projectile fired by said gun to strike said target.

* * * * *